US007416697B2

(12) United States Patent
Woodfield et al.

(10) Patent No.: US 7,416,697 B2
(45) **Date of Patent: *Aug. 26, 2008**

(54) METHOD FOR PREPARING A METALLIC ARTICLE HAVING AN OTHER ADDITIVE CONSTITUENT, WITHOUT ANY MELTING

(75) Inventors: Andrew Philip Woodfield, Cincinnati, OH (US); Eric Allen Ott, Cincinnati, OH (US); Clifford Earl Shamblen, Cincinnati, OH (US); Michael Francis Xavier Gigliotti, Glenville, NY (US)

(73) Assignee: General Electric Company, Schenectady, NY (US)

( * ) Notice: Subject to any disclaimer, the term of this patent is extended or adjusted under 35 U.S.C. 154(b) by 628 days.

This patent is subject to a terminal disclaimer.

(21) Appl. No.: 10/847,599

(22) Filed: May 17, 2004

(65) Prior Publication Data

US 2004/0208773 A1 Oct. 21, 2004

Related U.S. Application Data

(63) Continuation-in-part of application No. 10/371,743, filed on Feb. 19, 2003, and a continuation-in-part of application No. 10/350,968, filed on Jan. 22, 2003, now Pat. No. 6,921,510, and a continuation-in-part of application No. 10/329,143, filed on Dec. 23, 2002, now Pat. No. 7,037,463, and a continuation-in-part of application No. 10/172,218, filed on Jun. 14, 2002, now Pat. No. 7,329,381, and a continuation-in-part of application No. 10/172,217, filed on Jun. 14, 2002, now Pat. No. 6,737,017.

(51) Int. Cl.
*B22F 9/18* (2006.01)
*B22F 9/20* (2006.01)

(52) U.S. Cl. ..... 419/38; 419/30; 419/19; 419/10; 75/351; 75/367

(58) Field of Classification Search ..... 419/34
See application file for complete search history.

(56) References Cited

U.S. PATENT DOCUMENTS 2,799,570 A 7/1957 Reed et al.

(Continued)

FOREIGN PATENT DOCUMENTS

EP 1018 386 A1 12/2000

(Continued)

OTHER PUBLICATIONS

Powder Metallurgy Methods and Design, ed. By Howard I Sanderow, published in the ASM Handbook vol. 7, pp. 9-15.*

(Continued)

*Primary Examiner*—Roy King
*Assistant Examiner*—Christopher Kessler
(74) *Attorney, Agent, or Firm*—McNees Wallace & Nurick, LLC

(57) ABSTRACT

A method for preparing an article of a base metal alloyed with an alloying element includes the steps of preparing a compound mixture by the steps of providing a chemically reducible nonmetallic base-metal precursor compound of a base metal, providing a chemically reducible nonmetallic alloying-element precursor compound of an alloying element, and thereafter mixing the base-metal precursor compound and the alloying-element precursor compound to form a compound mixture. The compound mixture is thereafter reduced to a metallic alloy, without melting the metallic alloy. The step of preparing or the step of chemically reducing includes the step of adding an other additive constituent. The metallic alloy is thereafter consolidated to produce a consolidated metallic article, without melting the metallic alloy and without melting the consolidated metallic article.

28 Claims, 2 Drawing Sheets

U.S. PATENT DOCUMENTS

| | | | | |
|---|---|---|---|---|
| 2,828,199 | A | 3/1958 | Findlay | |
| 2,937,979 | A | 5/1960 | Wainer | |
| 3,449,115 | A | 6/1969 | Glamiche et al. | |
| 3,501,287 | A | 3/1970 | Lever | |
| 3,736,132 | A | 5/1973 | Easterday et al. | |
| 3,909,247 | A | 9/1975 | Paris et al. | |
| 3,925,114 | A * | 12/1975 | Takahashi et al. | 148/105 |
| 4,101,713 | A | 7/1978 | Hirsch | |
| 4,373,947 | A | 2/1983 | Buttner et al. | |
| 4,383,852 | A | 5/1983 | Yoshizawa | |
| 4,415,528 | A | 11/1983 | Wiech | |
| 4,512,826 | A | 4/1985 | Whang | |
| 4,519,839 | A | 5/1985 | Toyoaki et al. | |
| 4,525,206 | A | 6/1985 | Soled et al. | |
| 4,622,079 | A | 11/1986 | Chang et al. | |
| 4,687,632 | A | 8/1987 | Hurd et al. | |
| 4,731,111 | A | 3/1988 | Kopatz et al. | |
| 4,820,339 | A | 4/1989 | Bienvenu et al. | |
| 4,894,086 | A | 1/1990 | Huether et al. | |
| 4,906,436 | A | 3/1990 | Gigliotti, Jr. et al. | |
| 4,915,905 | A | 4/1990 | Kampe et al. | |
| 4,999,336 | A | 3/1991 | Nadkarni et al. | |
| 5,032,176 | A | 7/1991 | Kametani et al. | |
| 5,041,262 | A | 8/1991 | Gigliotti, Jr. | |
| 5,322,666 | A | 6/1994 | Watwe | |
| 5,328,501 | A | 7/1994 | McCormick et al. | |
| 5,431,874 | A | 7/1995 | Gigliotti, Jr. | |
| 5,779,761 | A | 7/1998 | Armstrong et al. | |
| 5,830,288 | A | 11/1998 | Gigliotti et al. | |
| 5,930,580 | A | 7/1999 | Everett | |
| 5,958,106 | A | 9/1999 | Armstrong et al. | |
| 6,019,812 | A | 2/2000 | Volas et al. | |
| 6,036,742 | A | 3/2000 | Schlegel Reinhold et al. | |
| 6,152,982 | A | 11/2000 | Froes et al. | |
| 6,251,159 | B1 | 6/2001 | Angeliu et al. | |
| 6,264,719 | B1 | 7/2001 | Zhang et al. | |
| 6,376,103 | B1 | 4/2002 | Sampath et al. | |
| 6,409,794 | B2 | 6/2002 | Wolmer et al. | |
| 6,485,584 | B1 | 11/2002 | Lambard et al. | |
| 6,540,811 | B2 | 4/2003 | Hosoe et al. | |
| 6,582,651 | B1 | 6/2003 | Cochrran, Jr. et al. | |
| 6,635,098 | B2 | 10/2003 | Abkowitz et al. | |
| 6,663,763 | B2 | 12/2003 | Strezov et al. | |
| 6,737,017 | B2 | 5/2004 | Woodfield et al. | |
| 6,849,229 | B2 * | 2/2005 | Ott et al. | 419/36 |
| 6,921,510 | B2 * | 7/2005 | Ott et al. | 419/10 |
| 6,926,754 | B2 * | 8/2005 | Shamblen et al. | 75/765 |
| 6,926,755 | B2 * | 8/2005 | Shamblen et al. | 75/765 |
| 6,968,990 | B2 * | 11/2005 | Ott et al. | 228/203 |
| 7,001,443 | B2 * | 2/2006 | Woodfield et al. | 75/351 |
| 7,037,463 | B2 * | 5/2006 | Woodfield et al. | 419/19 |
| 2002/0068005 | A1 | 6/2002 | Meyer et al. | |
| 2002/0073804 | A1 | 6/2002 | Meis | |
| 2003/0205108 | A1 | 11/2003 | Hong et al. | |
| 2003/0230170 | A1 | 12/2003 | Woodfield et al. | |
| 2003/0231974 | A1 | 12/2003 | Woodfield et al. | |
| 2004/0084323 | A1 | 5/2004 | Strezov et al. | |

FOREIGN PATENT DOCUMENTS

| | | | |
|---|---|---|---|
| EP | 1433 555 | A | 6/2004 |
| EP | 1486 575 | A | 12/2004 |
| EP | 1488 874 | A | 12/2004 |
| GB | 883 429 | A | 11/1961 |
| WO | WO 99/64638 | | 12/1999 |
| WO | WO 00/76698 | A1 | 12/2000 |

OTHER PUBLICATIONS

Matthew J. Donachie, Jr.: "Titanium (A Technical Guide"), ASM International, USA XP 002253129, p. 47-p. 51.

Doyle, Eoghan T.M. et al. "Carbothermic reduction of nickel-cobalt-chromium oxide mixture for the production of NiCoCr superalloy powder" EPD Congr. 1992, Proc. Symp. TMS Annu. Meet., 745-58. Editor(s): Hager, John P.; Publisher: Miner. Met. Mater. Soc., Warrendale, PA. Coden: 58HHA7, 1992, XP0009029023.

* cited by examiner

FIG. 1
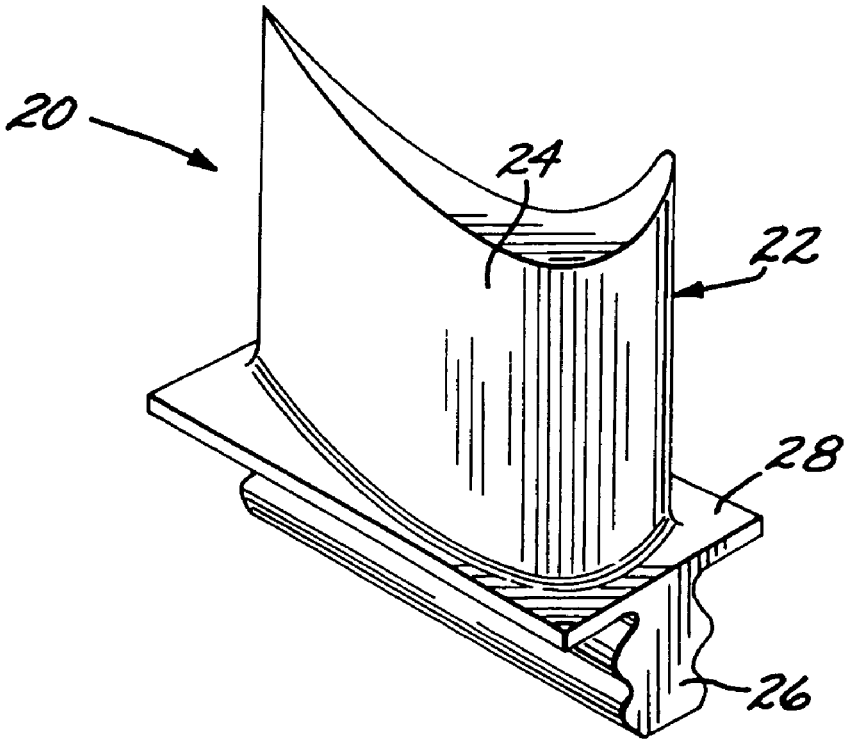
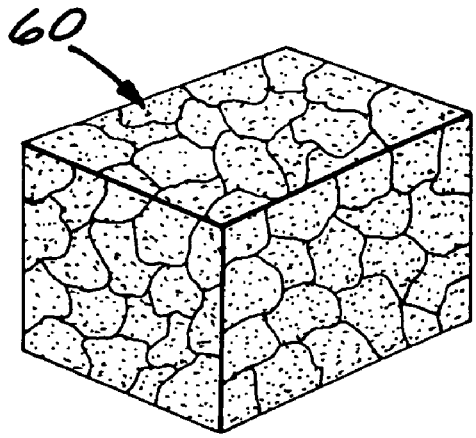
FIG. 3

METHOD FOR PREPARING A METALLIC ARTICLE HAVING AN OTHER ADDITIVE CONSTITUENT, WITHOUT ANY MELTING

This application is a continuation in part of application Ser. No. 10/172,217, now U.S. Pat. No. 6,737,017, filed Jun. 14, 2002, for which priority is claimed and whose disclosure is incorporated by reference; and a continuation in part of application Ser. No. 10/172,218, now U.S. Pat. No. 7,329,381, filed Jun. 14, 2002, for which priority is claimed and whose disclosure is incorporated by reference; and a continuation in part of application Ser. No. 10/329,143, now U.S. Pat. No. 7,037,463, filed Dec. 23, 2002, for which priority is claimed and whose disclosure is incorporated by reference; and a continuation in part of application Ser. No. 10/350,968, now U.S. Pat. No. 6,921,510, filed Jan. 22, 2003 for which priority is claimed and whose disclosure is incorporated by reference; and a continuation in part of application Ser. No. 10/371,743, filed Feb. 19, 2003, for which priority is claimed and whose disclosure is incorporated by reference.

This invention relates to the preparation of metallic-alloy articles having an other additive constituent, without melting of the metallic alloy.

BACKGROUND OF THE INVENTION

Metallic-alloy articles are prepared by any of a number of techniques, as may be appropriate for the nature of the article. In one common approach, metal-containing ores are refined to produce a molten metal, which is thereafter cast. The ores of the metals are refined as necessary to remove or reduce the amounts of undesirable minor elements. The composition of the refined metal may also be modified by the addition of desirable alloying elements. These refining and alloying steps may be performed during the initial melting process or after solidification and remelting. After a metal of the desired composition is produced, it may be used in the as-cast form for some alloy compositions (i.e., cast alloys), or mechanically worked to form the metal to the desired shape for other alloy compositions (i.e., wrought alloys). In either case, further processing such as heat treating, machining, surface coating, and the like may be utilized.

As applications of the metallic articles have become more demanding and as metallurgical knowledge of the interrelations between composition, structure, processing, and performance has improved, many modifications have been incorporated into the basic fabrication processing. As each performance limitation is overcome with improved processing, further performance limitations become evident and must be addressed. In some instances, performance limitations may be readily overcome, and in other instances the ability to overcome the limitations is hampered by fundamental physical laws associated with the fabrication processing and the inherent properties of the metals. Each potential modification to the processing technology and its resulting performance improvement is weighed against the cost of the processing change, to determine whether it is economically acceptable.

Incremental performance improvements resulting from processing modifications are still possible in a number of areas. However, the present inventors have recognized in the work leading to the present invention that in other instances the basic fabrication approach imposes fundamental performance limitations that cannot be overcome at any reasonable cost. They have recognized a need for a departure from the conventional thinking in fabrication technology which will overcome these fundamental limitations. The present invention fulfills this need, and further provides related advantages.

BRIEF SUMMARY OF THE INVENTION

The present invention provides a method for preparing an article made of an alloy of a metal such as titanium, aluminum, iron, nickel, cobalt, iron-nickel, iron-nickel-cobalt, and magnesium. The present approach circumvents problems which cannot be avoided in melting practice or are circumvented only with great difficulty and expense. The present approach permits a uniform alloy to be prepared without subjecting the constituents to the circumstance which leads to the problems, specifically the melting process. Unintentional oxidation of the reactive metal and the alloying elements is also avoided. The present approach permits the preparation of articles with compositions that may not be otherwise readily prepared in commercial quantities, including those having other additive constituents and, optionally, having thermophysically melt-incompatible alloying elements.

A method for preparing an article of a base metal alloyed with an alloying element comprises the step of preparing a precursor compound by the step of providing a chemically reducible nonmetallic base-metal precursor compound of a base metal. The method further includes thereafter chemically reducing the precursor compound to a metallic alloy, without melting the metallic alloy. The step of preparing or the step of chemically reducing includes the step of adding an other additive constituent. The metallic alloy is thereafter consolidated to produce a consolidated metallic article, without melting the metallic alloy and without melting the consolidated metallic article. The step of preparing may optionally include the additional steps of providing a chemically reducible nonmetallic alloying-element precursor compound of an alloying element, and thereafter mixing the base-metal precursor compound and the alloying-element precursor compound to form a compound mixture. There may be an additional step of reacting the other additive constituent.

The nonmetallic precursor compounds may be solid, liquid, or gaseous. The chemical reduction is preferably performed by solid-phase reduction, such as fused salt electrolysis of the precursor compounds in a finely divided solid form such as an oxide of the element; or by vapor-phase reduction, such as contacting vapor-phase halides of the base metal and the alloying element(s) with a liquid alkali metal or a liquid alkaline earth metal. The final article preferably has more titanium than any other element. The present approach is not limited to titanium-base alloys, however. Other alloys of current interest include aluminum-base alloys, iron-base alloys, nickel-base alloys, iron-nickel-base alloys, cobalt-base alloys, iron-nickel-cobalt-base alloys, and magnesium-base alloys, but the approach is operable with any alloys for which the nonmetallic precursor compounds are available that can be reduced to the metallic state.

The "other additive constituent" is defined as an element, mixture of elements, or compound that makes up a portion of the final alloy content and is introduced by a process different from the reduction process used to form the base metal. The other additive constituent may be dissolved into the matrix or may form discrete phases in the microstructure. The other additive constituent may be introduced by any operable approach, and four approaches are of particular interest. In a first approach, the step of preparing includes the step of furnishing the other additive constituent as an element or a compound and mixing the other additive constituent with the precursor compounds, and wherein the precursor compounds are reduced in the step of chemically reducing but the element or compound containing the other additive constituent is not reduced in the step of chemically reducing. In a second approach, the step of chemically reducing includes the step of mixing solid particles comprising the other additive constituent with the metallic alloy. In a third approach, the step of chemically reducing includes the step of depositing the other additive constituent from a gaseous phase on a surface of the metallic element or alloy, or on the surface of a precursor compound. In a fourth approach, the step of chemically reducing includes the step of depositing from a liquid phase the other additive constituent on a surface of the metallic element or alloy, or on the surface of a precursor compound. More than one other additive constituent may be introduced into the metal. One or more of the approaches for introducing other additive constituents may be used in combination. In some examples, the first approach may be practiced a single time to add one or more than one other additive constituent; or the first approach may be practiced more than one time to add more than one other additive constituent; or the first approach may be practiced to add one or more other additive constituents and the second approach may be practiced to add one or more other additive constituents.

The present approach for adding an other additive constituent is compatible with the addition of thermophysically melt incompatible alloying elements. In the alloys, there may be one or more thermophysically melt incompatible elements, and one or more elements that are not thermophysically melt incompatible with the base metal.

Thus, in another embodiment, a method for preparing an article made of a base metal (such as those discussed above) alloyed with an alloying element includes preparing a compound mixture by the steps of providing a chemically reducible nonmetallic base-metal precursor compound of the base metal, providing a chemically reducible nonmetallic alloying-element precursor compound of an alloying element (that optionally is thermophysically melt incompatible with the base metal), and thereafter mixing the base-metal precursor compound and the alloying-element precursor compound to form a compound mixture. The method further includes chemically reducing the compound mixture to produce a metallic alloy, without melting the metallic alloy. The step of preparing or the step of chemically reducing includes the step of adding an other additive constituent. The metallic alloy is thereafter consolidated to produce a consolidated metallic article, without melting the metallic alloy and without melting the consolidated metallic article. Other compatible features described herein may be used with this embodiment.

Some additional processing steps may be included in the present process. In some cases, it is preferred that the precursor compound mixture be compacted, after the step of mixing and before the step of chemical reduction. The result is a compacted mass which, when chemically reduced, produces a spongy metallic material. After the chemical reduction step, the metallic alloy is consolidated to produce a consolidated metallic article, without melting the metallic alloy and without melting the consolidated metallic article. This consolidation may be performed with any physical form of the metallic alloy produced by the chemical reduction, but the approach is particularly advantageously applied to consolidating of the pre-compacted sponge. Consolidation is preferably performed by hot pressing, hot isostatic pressing, or extrusion, but without melting in each case. Solid state diffusion of the alloying elements may also be used to achieve the consolidation.

The consolidated metallic article may be used in the as-consolidated form. In appropriate circumstances, it may be formed to other shapes using known forming techniques such as rolling, forging, extrusion, and the like. It may also be post-processed by known techniques such as machining, heat treating, surface coating, and the like.

The present approach is used to prepare articles from the precursor compounds, entirely without melting. As a result, the characteristics of any alloying elements which lead to problems during melting are avoided and cannot lead to inhomogeneities or irregularities in the final metallic alloy. The present approach thus produces the desired alloy composition of good quality, but without interference from melt-related problems that otherwise would prevent the formation of an acceptable alloy and microstructure.

The present approach differs from prior approaches in that the metal is not melted on a gross scale. Melting and its associated processing such as casting are expensive and also produce some undesirable microstructures that either are unavoidable or can be altered only with additional expensive processing modifications. The present approach reduces cost and avoids structures and irregularities associated with melting and casting, to improve mechanical properties of the final metallic article. It also results in some cases in an improved ability to fabricate specialized shapes and forms more readily, and to inspect those articles more readily. Additional benefits are realized in relation to particular metallic alloy systems, for example the reduction of the alpha case for susceptible titanium alloys.

The preferred form of the present approach also has the advantage of being based in a powder-form precursor. Starting with a powder of the nonmetallic precursor compounds avoids a cast structure with its associated irregularities such as elemental segregation on a nonequilibrium microscopic and macroscopic level, a cast microstructure with a range of grain sizes and morphologies that must be homogenized in some manner for many applications, gas entrapment, and contamination. The present approach produces a uniform, fine-grained, homogeneous, pore-free, gas-pore-free, and low-contamination final product.

Other features and advantages of the present invention will be apparent from the following more detailed description of the preferred embodiment, taken in conjunction with the accompanying drawings, which illustrate, by way of example; the principles of the invention. The scope of the invention is not, however, limited to this preferred embodiment.

BRIEF DESCRIPTION OF THE DRAWINGS

FIG. 1 is a perspective view of a metallic article prepared according to the present approach;

FIG. 3 is a perspective view of a spongy mass of the initial metallic material.

DETAILED DESCRIPTION OF THE INVENTION

Figure 2:
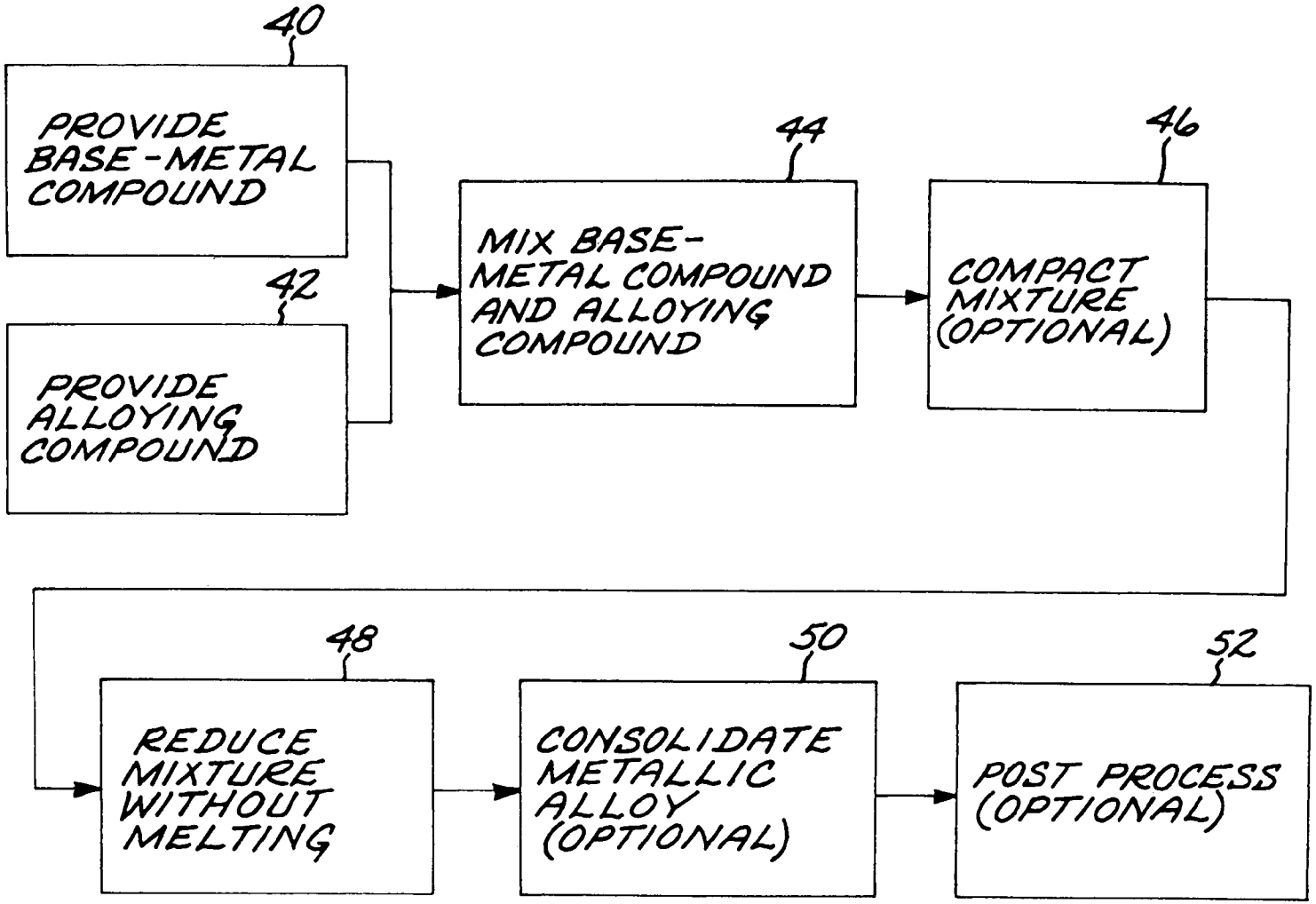
FIG. 2 is a block flow diagram of an approach for practicing the invention.

The present approach may be used to make a wide variety of metallic articles 20, such as a gas turbine compressor blade 22 of FIG. 1. The compressor blade 22 includes an airfoil 24, an attachment 26 that is used to attach the structure to a compressor disk (not shown), and a platform 28 between the airfoil 24 and the attachment 26. The compressor blade 22 is only one example of the types of articles 20 that may be fabricated by the present approach. Some other examples include other gas turbine parts such as fan blades, fan disks, compressor disks, turbine blades, turbine disks, bearings, blisks, cases, and shafts, automobile parts, biomedical articles, and structural members such as airframe parts. There is no known limitation on the types of articles that may be made by this approach.

FIG. 2 illustrates a preferred approach for preparing an article of a base metal and an alloying element. The method comprises providing a chemically reducible nonmetallic base-metal precursor compound, step 40, and providing a chemically reducible nonmetallic alloying-element precursor compound, step 42. "Nonmetallic precursor compounds" are nonmetallic compounds of the metals that eventually constitute the metallic article 20. Any operable nonmetallic precursor compounds may be used. Reducible oxides of the metals are the preferred nonmetallic precursor compounds in solid-phase reduction, but other types of nonmetallic compounds such as sulfides, carbides, halides, and nitrides are also operable. Reducible halides of the metals are the preferred nonmetallic precursor compounds in vapor-phase reduction. The base metal is a metal that is present in a greater percentage by weight than any other element in the alloy. The base-metal compound is present in an amount such that, after the chemical reduction to be described subsequently, there is more of the base metal present in the metallic alloy than any other element. In the preferred case, the base metal is titanium, and the base-metal compound is titanium oxide, $TiO_2$ (for solid-phase reduction) or titanium tetrachloride (for vapor-phase reduction). The alloying element may be any element that is available in the chemically reducible form of the precursor compound. A few illustrative examples are cadmium, zinc, silver, iron, cobalt, chromium, bismuth, copper, tungsten, tantalum, molybdenum, aluminum, niobium, nickel, manganese, magnesium, lithium, beryllium, and the rare earths.

The nonmetallic precursor compounds are selected to provide the necessary metals in the final metallic article, and are mixed together in the proper proportions to yield the necessary proportions of these metals in the metallic article. These precursor compounds are furnished and mixed together in the correct proportions such that the ratio of base metal and alloying additions in the mixture of precursor compounds is that required in the metallic alloy that forms the final article.

The base-metal compound and the alloying compound are finely divided solids or gaseous in form to ensure that they are chemically reacted in the subsequent step. The finely divided base-metal compound and alloying compound may be, for example, powders, granules, flakes, or the like. The preferred maximum dimension of the finely divided form is about 100 micrometers, although it is preferred that the maximum dimension be less than about 10 micrometers to ensure good reactivity.

The present approach may be utilized in conjunction with thermophysically melt incompatible alloys. "Thermophysical melt incompatibility" and related terms refer to the basic concept that any identified thermophysical property of an alloying element is sufficiently different from that of the base metal, in the preferred case titanium, to cause detrimental effects in the melted final product. These detrimental effects include phenomena such as chemical inhomogeneity (detrimental micro-segregation, macro-segregation such as beta flecks, and gross segregation from vaporization or immiscibility), inclusions of the alloying elements (such as high-density inclusions from elements such as tungsten, tantalum, molybdenum, and niobium), and the like. Thermophysical properties are intrinsic to the elements, and combinations of the elements which form alloys, and are typically envisioned using equilibrium phase diagrams, vapor pressure versus temperature curves, curves of densities as a function of crystal structure and temperature, and similar approaches. Although alloy systems may only approach predicted equilibrium, these envisioning data provide information sufficient to recognize and predict the cause of the detrimental effects as thermophysical melt incompatibilities. However, the ability to recognize and predict these detrimental effects as a result of the thermophysical melt incompatibility does not eliminate them. The present approach provides a technique to minimize and desirably avoid the detrimental effects by the elimination of melting in the preparation and processing of the alloy.

Thus, a thermophysical melt incompatible alloying element or elements in the alloy to be produced do not form a well mixed, homogeneous alloy with the base metal in a production melting operation in a stable, controllable fashion. In some instances, a thermophysically melt incompatible alloying element cannot be readily incorporated into the alloy at any compositional level, and in other instances the alloying element can be incorporated at low levels but not at higher levels. For example, iron does not behave in a thermophysically melt incompatible manner when introduced at low levels in titanium, typically up to about 0.3 weight percent, and homogeneous titanium-iron-containing alloys of low iron contents may be prepared. However, if iron is introduced at higher levels into titanium, it tends to segregate strongly in the melt and thus behaves in a thermophysically melt incompatible manner so that homogeneous alloys can only be prepared with great difficulty. In other examples, when magnesium is added to a titanium melt in vacuum, the magnesium immediately begins to vaporize due to its low vapor pressure, and therefore the melting cannot be accomplished in a stable manner. Tungsten tends to segregate in a titanium melt due to its density difference with titanium, making the formation of a homogeneous titanium-tungsten alloy extremely difficult.

The thermophysical melt incompatibility of the alloying element with a base metal may be any of several types. Because titanium is the preferred base metal, some illustrative examples for titanium are included in the following discussion.

One such thermophysical melt incompatibility is in the vapor pressure, as where the alloying element has an evaporation rate of greater than about 100 times that of titanium at a melt temperature, which is preferably a temperature just above the liquidus temperature of the alloy. Examples of such alloying elements in titanium include cadmium, zinc, bismuth, magnesium, and silver. Where the vapor pressure of the alloying element is too high, it will preferentially evaporate, as indicated by the evaporation rate values, when co-melted with titanium under a vacuum in conventional melting practice. An alloy will be formed, but it is not stable during melting and continuously loses the alloying element so that the percentage of the alloying element in the final alloy is difficult to control. In the present approach, because there is no vacuum melting, the high melt vapor pressure of the alloying element is not a concern.

Another such thermophysical melt incompatibility occurs when the melting point of the alloying element is too high or too low to be compatible with that of the base metal, as where the alloying element has a melting point different from (either greater than or less than) that of the base metal of more than about 400° C. (720° F.). Examples of such alloying elements in titanium include tungsten, tantalum, molybdenum, magnesium, and tin. If the melting point of the alloying element is too high, it is difficult to melt and homogenize the alloying element into the titanium melt in conventional vacuum melting practice. The segregation of such alloying elements may result in the formation of high-density inclusions containing that element, for example tungsten, tantalum, or molybdenum inclusions. If the melting point of the alloying element is too low, it will likely have an excessively high vapor pressure at the temperature required to melt the titanum. In the present approach, because there is no vacuum melting, the overly high or low melting points are not a concern.

Another such thermophysical melt incompatibility occurs when the density of the alloying element is so different from that of the base metal that the alloying element physically separates in the melt, as where the alloying element has a density difference with the base metal of greater than about 0.5 gram per cubic centimeter. Examples of such alloying elements in titanium include tungsten, tantalum, molybdenum, niobium, and aluminum. In conventional melting practice, the overly high or low density leads to gravity-driven segregation of the alloying element. In the present approach, because there is no melting there can be no gravity-driven segregation.

Another such thermophysical melt incompatibility occurs when the alloying element chemically reacts with the base metal in the liquid phase. Examples of such alloying elements in titanium include oxygen, nitrogen, silicon, boron, and beryllium. In conventional melting practice, the chemical reactivity of the alloying element with the base metal leads to the formation of intermetallic compounds including the base metal and the alloying element, and/or other deleterious phases in the melt, which are retained after the melt is solidified. These phases often have adverse effects on the properties of the final alloy. In the present approach, because the metals are not heated to the point where these reactions occur, the compounds are not formed.

Another such thermophysical melt incompatibility occurs when the alloying element exhibits a miscibility gap with the base metal in the liquid phase. Examples of such alloying elements in titanium include the rare earths such as cerium, gadolinium, lanthanum, and neodymium. In conventional melting practice, a miscibility gap leads to a segregation of the melt into the compositions defined by the miscibility gap. The result is inhomogeneities in the melt, which are retained in the final solidified article. The inhomogeneities lead to variations in properties throughout the final article. In the present approach, because the elements are not melted, the miscibility gap is not a concern.

Another, more complex thermophysical melt incompatibility involves the strong beta stabilizing elements that exhibit large liquidus-to-solidus gaps when alloyed with titanium. Some of these elements, such as iron, cobalt, and chromium, typically exhibit eutectic (or near-eutectic) phase reactions with titanium, and also usually exhibit a solid state-eutectoid decomposition of the beta phase into alpha phase plus a compound. Other such elements, such as bismuth and copper, typically exhibit peritectic phase reactions with titanium yielding beta phase from the liquid, and likewise usually exhibit a solid state eutectoid decomposition of the beta phase into alpha phase plus a compound. Such elements present extreme difficulties in achieving alloy homogeneity during solidification from the melt. This results not only because of normal solidification partitioning causing micro-segregation, but also because melt process perturbations are known to cause separation of the beta-stabilizing-element-rich liquid during solidification to cause macro-segregation regions typically called beta flecks.

Another thermophysical melt incompatibility is not strictly related to the nature of the base metal, but instead to the crucibles or environment in which the base metal is melted. Base metals may require the use of a particular crucible material or melting atmosphere, and some potential alloying elements may react with those crucible materials or melting atmospheres, and therefore not be candidates as alloying elements for that particular base metal.

Another thermophysical melt incompatibility involves elements such as the alkali metals and alkali-earth metals that have very limited solubility in base-metal alloys. Examples in titanium include lithium and calcium. Finely divided dispersions of these elements, for example beta calcium in alpha titanium, may not be readily achieved using a melt process.

These and other types of thermophysical melt incompatibilities lead to difficulty or impossibility in forming acceptable alloys of these elements in conventional production melting. Their adverse effects are avoided in the present meltless approach.

The base-metal compound and the alloying compound are mixed to form a uniform, homogeneous compound mixture, step 44. The mixing is performed by conventional procedures used to mix powders in other applications, for solid-phase reduction, or by the mixing of the vapors, for vapor-phase reduction.

Optionally, for solid-phase reduction of solid precursor compound powders the compound mixture is compacted to make a preform, step 46. This compaction is conducted by cold or hot pressing of the finely divided compounds, but not at such a high temperature that there is any melting of the compounds. The compacted shape may be sintered in the solid state to temporarily bind the particles together. The compacting desirably forms a shape similar to, but larger in dimensions than, the shape of the final article, or intermediate product form.

The mixture of nonmetallic precursor compounds is thereafter chemically reduced by any operable technique to produce an initial metallic material, without melting the initial metallic material, step 48. As used herein, "without melting", "no melting", and related concepts mean that the material is not macroscopically or grossly melted, so that it liquefies and loses its shape. There may be, for example, some minor amount of localized melting as low-melting-point elements melt and are diffusionally alloyed with the higher-melting-point elements that do not melt. Even in such cases, the gross shape of the material remains unchanged.

In one approach, termed solid-phase reduction because the nonmetallic precursor compounds are furnished as solids, the chemical reduction may be performed by fused salt electrolysis. Fused salt electrolysis is a known technique that is described, for example, in published patent application WO 99/64638, whose disclosure is incorporated by reference in its entirety. Briefly, in fused salt electrolysis the mixture of nonmetallic precursor compounds is immersed in an electrolysis cell in a fused salt electrolyte such as a chloride salt at a temperature below the melting temperatures of the metals that form the nonmetallic precursor compounds. The mixture of nonmetallic precursor compounds is made the cathode of the electrolysis cell, with an anode. The elements combined with the metals in the nonmetallic precursor compounds, such as oxygen in the preferred case of oxide nonmetallic precursor compounds, are removed from the mixture by chemical reduction (i.e., the reverse of chemical oxidation). The reaction is performed at an elevated temperature to accelerate the diffusion of the oxygen or other gas away from the cathode. The cathodic potential is controlled to ensure that the reduction of the nonmetallic precursor compounds will occur, rather than other possible chemical reactions such as the decomposition of the molten salt. The electrolyte is a salt, preferably a salt that is more stable than the equivalent salt of the metals being refined and ideally very stable to remove the oxygen or other gas to a low level. The chlorides and mixtures of chlorides of barium, calcium, cesium, lithium, strontium, and yttrium are preferred. The chemical reduction may be carried to completion, so that the nonmetallic precursor compounds are completely reduced. The chemical reduction may instead be partial, such that some nonmetallic precursor compounds remain.

In another approach, termed vapor-phase reduction because the nonmetallic precursor compounds are furnished as vapors or gaseous phase, the chemical reduction may be performed by reducing mixtures of halides of the base metal and the alloying elements using a liquid alkali metal or a liquid alkaline earth metal. For example, titanium tetrachloride and the chlorides of the alloying elements are provided as gases. A mixture of these gases in appropriate amounts is contacted to molten sodium, so that the metallic halides are reduced to the metallic form. The metallic alloy is separated from the sodium. This reduction is performed at temperatures below the melting point of the metallic alloy. The approach is described more fully in U.S. Pat. Nos. 5,779,761 and 5,958,106, whose disclosures are incorporated by reference.

The physical form of the initial metallic material at the completion of step 48 depends upon the physical form of the mixture of nonmetallic precursor compounds at the beginning of step 48. If the mixture of nonmetallic precursor compounds is free-flowing, finely divided particles, powders, granules, pieces, or the like, the initial metallic material is also in the same form, except that it is smaller in size and typically somewhat porous. If the mixture of nonmetallic precursor compounds is a compressed mass of the finely divided particles, powders, granules, pieces, or the like, then the final physical form of the initial metallic material is typically in the form of a somewhat porous metallic sponge 60, as shown in FIG. 3. The external dimensions of the metallic sponge are smaller than those of the compressed mass of the nonmetallic precursor compound due to the removal of the oxygen and/or other combined elements in the reduction step 48. If the mixture of nonmetallic precursor compounds is a vapor, then the final physical form of the initial metallic material is typically fine powder that may be further processed.

Some constituents, termed "other additive constituents", may be difficult to introduce into the alloy. For example, suitable nonmetallic precursor compounds of the constituents may not be available, or the available nonmetallic precursor compounds of the other additive constituents may not be readily chemically reducible in a manner or at a temperature consistent with the chemical reduction of the other nonmetallic precursor compounds. It may be necessary that such other additive constituents ultimately be present as elements in solid solution in the alloy, as compounds formed by reaction with other constituents of the alloy, or as already-reacted, substantially inert compounds dispersed through the alloy. These other additive constituents or precursors thereof may be introduced from the gas, liquid, or solid phase, as may be appropriate, using one of the four approaches subsequently described or other operable approaches.

In a first approach, the other additive constituents are furnished as elements or compounds and are mixed with the precursor compounds prior to or concurrently with the step of chemically reducing. The mixture of precursor compounds and other additive constituents is subjected to the chemical reduction treatment of step 48, but only the precursor compounds are actually reduced and the other additive constituents are not reduced.

In a second approach, the other additive constituents in the form of solid particles are furnished but are not subjected to the chemical reduction treatment used for the base metal. Instead, they are mixed with the initial metallic material that results from the chemical reduction step, but after the step of chemically reducing 48 is complete. This approach is particularly effective when the step of chemically reducing is performed on a flowing powder of the precursor compounds, but it also may be performed using a pre-compacted mass of the precursor compounds, resulting in a spongy mass of the initial metallic material. The other additive constituents are adhered to the surface of the powder or to the surface of, and into the porosity of, the spongy mass. Solid particles may be optionally reacted in one or more steps if they are precursors to the other additive constituent.

In a third approach, the precursor is first produced as powder particles, or as a sponge by compacting the precursor compounds of the metallic elements. The particles are, or the sponge is, then chemically reduced. The other additive constituent is thereafter produced at the surfaces (external and internal, if the particles are spongelike) of the particles, or at the external and internal surfaces of the sponge, from the gaseous phase. In one technique, a gaseous precursor or elemental form (e.g., methane, nitrogen, or borane gas) is flowed over the surface of the particle or sponge to deposit the compound or element onto the surface from the gas. The material produced at the surfaces may be optionally reacted in one or more steps if they are precursors to the other additive constituent. In an example, boron is supplied to a titanium surface by flowing borane over the surface, and in subsequent processing the deposited boron is reacted to form titanium diboride. The gas carrying the constituent of interest may be supplied in any operable manner, such as from a commercially available gas or by generating the gas such as by the electron beam vaporization of a ceramic or metal, or using a plasma.

A fourth approach is similar to the third approach, except that the other additive constituent is deposited from a liquid rather than from a gas. The precursor is first produced as powder particles, or as a sponge by compacting the precursor compounds of the metallic elements. The particles are, or the sponge is, then chemically reduced. The other additive constituent is thereafter produced at the surfaces (external and internal, if the particles are spongelike) of the particles, or at the external and internal surfaces of the sponge, by deposition from the liquid. In one technique, the particulate or sponge is dipped into a liquid solution of a precursor compound of the other additive constituent to coat the surfaces of the particles or the sponge. The precursor compound of the other additive constituent is second chemically reacted to leave the other additive constituent at the surfaces of the particles or at the surfaces of the sponge. In an example, lanthanum may be introduced into a titanium-base alloy by coating the surfaces of the reduced particles or sponge (produced from the precursor compounds) with lanthanum chloride. The coated particles are, or the sponge is, thereafter heated and/or exposed to vacuum to drive off the chlorine, leaving lanthanum at the surfaces of the particles or sponge. Optionally, the lanthanum-coated particles or sponge may be oxidized to form a fine lanthanum-oxygen dispersion, using oxygen from the environment or from solution in the metal, or the lanthanum-coated particles or sponge may be reacted with another element such as sulfur. In another approach, the constituent is electrochemically plated onto the particles or the sponge. In yet another approach, the particles or sponge may be dipped into a bath containing the other additive constituent, removed from the bath, and any solvent or carrier evaporated to leave a coating on the surface of the particle or sponge.

Whatever the reduction technique used in step 48 and however the other additive constituent is introduced, the result is a mixture that comprises the alloy composition. Methods for introducing other additive constituents may be performed on precursors prior to the reduction of the base-metal constituent, or on already-reduced material. The metallic alloy may be free-flowing particles in some circumstances, or have a sponge-like structure in other cases. The sponge-like structure is produced in the solid-phase reduction approach if the precursor compounds have first been compacted together prior to the commencement of the actual chemical reduction. The precursor compounds may be compressed to form a compressed mass that is larger in dimensions than a desired final metallic article.

The chemical composition of the initial metallic alloy is determined by the types and amounts of the metals in the mixture of nonmetallic precursor compounds furnished in steps 40 and 42, and by the other additive constituents that are introduced in the processing. The relative proportions of the metallic elements are determined by their respective ratios in the mixture of step 44 (not by the respective ratios of the compounds, but the respective ratios of the metallic element). In a case of most interest, the initial metallic alloy has more titanium than any other element as the base metal, producing a titanium-base initial metallic alloy. Other base metals of interest include aluminum, iron, nickel, cobalt, iron-nickel, iron-nickel-cobalt, and magnesium.

The initial metallic alloy is typically in a form that is not structurally useful for most applications. Accordingly and preferably, the initial metallic alloy is thereafter consolidated to produce a consolidated metallic article, without melting the initial metallic alloy and without melting the consolidated metallic article, step 50. The consolidation removes porosity from the initial metallic alloy, desirably increasing its relative density to or near 100 percent. Any operable type of consolidation may be used. It is preferred that the consolidation be performed without a binder, which is an organic or inorganic material mixed with the powder to aid in adhering the powder particles to each other during the consolidation processing. The binder may leave an undesirable residue in the final structure, and its use is therefore preferably avoided.

Preferably, the consolidation 50 is performed by hot isostatic pressing the initial metallic alloy under appropriate conditions of temperature and pressure, but at a temperature less than the melting points of the initial metallic alloy and the consolidated metallic article (which melting points are typically the same or very close together). Pressing, solid-state sintering, and canned extrusion may also be used, particularly where the initial metallic alloy is in the form of a powder. The consolidation reduces the external dimensions of the mass of initial metallic alloy, but such reduction in dimensions are predictable with experience for particular compositions. The consolidation processing 50 may also be used to achieve further alloying of the metallic article. For example, the can used in hot isostatic pressing may not be evacuated so that there is a residual oxygen and nitrogen content, or a carbon-containing gas could be introduced into the can. Upon heating for the hot isostatic pressing, the residual oxygen, nitrogen, and/or carbon diffuses into and alloys with the titanium-base alloy.

The consolidated metallic article, such as that shown in FIG. 1, may be used in its as-consolidated form. Instead, in appropriate cases the consolidated metallic article may optionally be post processed, step 52. The post processing may include forming by any operable metallic forming process, as by forging, extrusion, rolling, and the like. Some metallic compositions are amenable to such forming operations, and others are not. The consolidated metallic article may also or instead be optionally post-processing by other conventional metal processing techniques in step 52. Such post-processing may include, for example, heat treating, surface coating, machining, and the like.

The metallic material is never heated above its melting point. Additionally, it may be maintained below specific temperatures that are themselves below the melting point. For example, when an alpha-beta titanium-base alloy is heated above the beta transus temperature, beta phase is formed. The beta phase transforms to alpha phase when the alloy is cooled below the beta transus temperature. For some applications, it is desirable that the metallic alloy not be heated to a temperature above the beta transus temperature. In this case care is taken that the alloy sponge or other metallic form is not heated above its beta transus temperature at any point during the processing. The result is a fine microstructure that is free of alpha-phase colonies and may be made superplastic more readily than a coarse microstructure. Because of the fine particle size resulting from this processing, less work is required to reach a fine structure in the final article, leading to a lower-cost product. Subsequent manufacturing operations are simplified because of the lower flow stress of the material, so that smaller, lower-cost forging presses and other metalworking machinery may be employed, and their is less wear on the machinery.

In other cases such as some airframe components and structures, it is desirable to heat the alloy above the beta transus and into the beta phase range, so that beta phase is produced and the toughness of the final product is improved. In this case, the metallic alloy may be heated to temperatures above the beta transus temperature during the processing, but in any case not above the melting point of the alloy. When the article heated above the beta transus temperature is cooled again to temperatures below the beta transus temperature, a fine colony structure is formed that can make ultrasonic inspection of the article more difficult. In that case, it may be desirable for the article to be fabricated and ultrasonically inspected at low temperatures, without having been heated to temperatures above the beta transus temperature, so that it is in a colony free state. After completion of the ultrasonic inspection to verify that the article is irregularity-free, it may then be heat treated at a temperature above the beta transus temperature and cooled. The final article is less inspectable than the article which has not been heated above the beta transus, but the absence of irregularities has already been established.

The microstructural type, morphology, and scale of the article is determined by the starting materials and the processing. The grains of the articles produced by the present approach generally correspond to the morphology and size of the powder particles of the starting materials, when the solid-phase reduction technique is used. Thus, a 5-micrometer precursor particle size produces a final grain size on the order of about 5 micrometers. It is preferred for most applications that the grain size be less than about 10 micrometers, although the grain size may be as high as 100 micrometers or larger. As discussed earlier, the present approach applied to titanium-base alloys avoids a coarse alpha-colony structure resulting from transformed coarse beta grains, which, in conventional melt-based processing, is produced when the melt cools into the beta region of the phase diagram. In the present approach, the metal is never melted and cooled from the melt into the beta region, so that the coarse beta grains never occur. Beta grains may be produced during subsequent processing as described above, but they are produced at lower temperatures than the melting point and are therefore much finer than are beta grains resulting from cooling from the melt in conventional practice. In conventional melt-based practice, subsequent metalworking processes are designed to break up and globularize the coarse alpha structure associated with the colony structure. Such processing is not required in the present approach because the structure as produced is fine and does not comprise alpha plates.

The present approach processes the mixture of nonmetallic precursor compounds to a finished metallic form without the metal of the finished metallic form ever being heated above its melting point. Consequently, the process avoids the costs associated with melting operations, such as controlled-atmosphere or vacuum furnace costs in the case of titanium-base alloys. The microstructures associated with melting, typically large-grained structures and casting irregularities, are not found. Without such irregularities, the articles may be made lighter in weight because extra material introduced to compensate for the irregularities may be eliminated. The greater confidence in the irregularity-free state of the article, achieved with the better inspectability discussed above, also leads to a reduction in the extra material that must otherwise be present. In the case of susceptible titanium-base alloys, the incidence of alpha case formation is also reduced or avoided, because of the reducing environment. Mechanical properties such as static strength and fatigue strength are improved.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for preparing an article of a base metal alloyed with an alloying element, comprising the steps of preparing a precursor compound by the step of providing a chemically reducible nonmetallic base-metal precursor compound of a base metal;

providing a chemically reducible nonmetallic alloying-element precursor compound of an alloying element, wherein the alloying element is thermophysically melt incompatible with the base metal, and thereafter mixing the base-metal precursor compound and the alloying-element precursor compound to form a compound mixture; thereafter chemically reducing the precursor compound to a metallic alloy, without melting the metallic alloy, wherein the step of preparing or the step of chemically reducing includes the step of adding an other additive constituent; and thereafter consolidating the metallic alloy to produce a consolidated metallic article, without melting the metallic alloy and without melting the consolidated metallic article, wherein the step of preparing includes the step of furnishing the other additive constituent as an element, mixture of elements, or a compound and mixing the other additive constituent with the precursor compounds, and wherein the precursor compounds are reduced in the step of chemically reducing but the element, mixture of elements, or compound containing the other additive constituent is not reduced in the step of chemically reducing, or wherein the step of chemically reducing includes a step selected from group consisting of mixing solid particles comprising the other additive constituent with the metallic alloy, depositing from a gaseous phase the other additive constituent on a surface of the metallic alloy, and depositing from a liquid phase the other additive constituent on a surface of the metallic alloy.

2. The method of claim 1, including an additional step of reacting the other additive constituent.

3. The method of claim 1, wherein the step of providing a chemically reducible nonmetallic base-metal precursor compound of a base metal includes the step of selecting the base metal as titanium, aluminum, iron, nickel, cobalt, iron-nickel, iron-nickel-cobalt, or magnesium.

4. The method of claim 1, wherein the step of providing a chemically reducible nonmetallic base-metal precursor compound of a base metal includes the step of selecting the base metal as titanium.

5. The method of claim 1, wherein the step of preparing includes the step of furnishing the other additive constituent as an element, mixture of elements, or a compound and mixing the other additive constituent with the precursor compounds, and wherein the precursor compounds are reduced in the step of chemically reducing but the element, mixture of elements, or compound containing the other additive constituent is not reduced in the step of chemically reducing.

6. The method of claim 1, wherein the step of chemically reducing includes the step of mixing solid particles comprising the other additive constituent with the metallic alloy.

7. The method of claim 1, wherein the step of chemically reducing includes the step of depositing from a gaseous phase the other additive constituent on a surface of the metallic alloy.

8. The method of claim 1, wherein the step of chemically reducing includes the step of depositing from a liquid phase the other additive constituent on a surface of the metallic alloy.

9. The method of claim 1, wherein the step of providing the chemically reducible nonmetallic base-metal precursor compound includes the step of providing the chemically reducible nonmetallic base-metal precursor compound in a finely divided solid form, and wherein the step of providing the chemically reducible nonmetallic alloying-element precursor compound includes the step of providing the chemically reducible nonmetallic alloying-element precursor compound in a finely divided solid form.

10. The method of claim 1, wherein the step of providing the chemically reducible nonmetallic base-metal precursor compound includes the step of providing the chemically reducible nonmetallic base-metal precursor compound in a gaseous form, and wherein the step of providing the chemically reducible nonmetallic alloying-element precursor compound includes the step of providing a chemically reducible nonmetallic alloying-element precursor compound in a gaseous form.

11. The method of claim 1, wherein the step of providing a chemically reducible nonmetallic base-metal precursor compound includes the step of providing a chemically reducible base-metal oxide.

12. The method of claim 1, wherein the step of providing the chemically reducible nonmetallic alloying-element precursor compound of the alloying element includes the step of providing a chemically reducible alloying-element oxide.

13. The method of claim 1, wherein the step of chemically reducing includes the step of chemically reducing the compound mixture by solid-phase reduction.

14. The method of claim 1, wherein the step of chemically reducing includes the step of chemically reducing the compound mixture by fused salt electrolysis.

15. The method of claim 1, wherein the step of chemically reducing includes the step of chemically reducing the compound mixture by vapor-phase reduction.

16. A method for preparing an article made of titanium alloyed with an alloying element, comprising the steps of preparing a compound mixture by the steps of providing a chemically reducible nonmetallic base-metal precursor compound of titanium base metal;

providing a chemically reducible nonmetallic alloying-element precursor compound of an alloying element that is thermophysically melt incompatible with the titanium base metal; and thereafter mixing the base-metal precursor compound and the alloying-element precursor compound to form a compound mixture; thereafter chemically reducing the compound mixture to produce a metallic alloy, without melting the metallic alloy, wherein the step of preparing or the step of chemically reducing includes the step of adding an other additive constituent; and thereafter consolidating the metallic alloy to produce a consolidated metallic article, without melting the metallic alloy and without melting the consolidated metallic article wherein the step of preparing includes the step of furnishing the other additive constituent as an element, mixture of elements, or a compound and mixing the other additive constituent with the precursor compounds, and wherein the precursor compounds are reduced in the step of chemically reducing but the element, mixture of elements, or compound containing the other additive constituent is not reduced in the step of chemically reducing, or wherein the step of chemically reducing includes a step selected from group consisting of mixing solid particles comprising the other additive constituent with the metallic alloy, depositing from a gaseous phase the other additive constituent on a surface of the metallic alloy, and depositing from a liquid phase the other additive constituent on a surface of the metallic alloy.

17. The method of claim 16, including an additional step of reacting the other additive constituent.

18. The method of claim 16, wherein the step of preparing includes the step of furnishing the other additive constituent as an element or a compound and mixing the other additive constituent with the precursor compounds, and wherein the precursor compounds are reduced in the step of chemically reducing but the element or compound containing the other additive constituent is not reduced in the step of chemically reducing.

19. The method of claim 16, wherein the step of chemically reducing includes the step of mixing solid particles comprising the other additive constituent with the metallic alloy.

20. The method of claim 16, wherein the step of chemically reducing includes the step of depositing from a gaseous phase the other additive constituent on a surface of the metallic alloy.

21. The method of claim 16, wherein the step of chemically reducing includes the step of depositing from a liquid phase the other additive constituent on a surface of the metallic alloy.

22. The method of claim 16, wherein the step of providing the chemically reducible nonmetallic alloying-element precursor compound of the alloying element includes the step of providing the chemically reducible nonmetallic alloying-element precursor compound of the alloying element, wherein the alloying element has a vapor pressure of greater than about 100 times a vapor pressure of titanium in a titanium melt, both measured at a melt temperature.

23. The method of claim 16, wherein the step of providing the chemically reducible nonmetallic alloying-element precursor compound of the alloying element includes the step of providing the chemically reducible nonmetallic alloying-element precursor compound of the alloying element, wherein the alloying element has a melting point different from that of titanium by more than about 400° C.

24. The method of claim 16, wherein the step of providing the chemically reducible nonmetallic alloying-element precursor compound of the alloying element includes the step of providing the chemically reducible nonmetallic alloying-element precursor compound of the alloying element, wherein the alloying element has a density difference with titanium of greater than about 0.5 gram per cubic centimeter.

25. The method of claim 16, wherein the step of providing the chemically reducible nonmetallic alloying-element precursor compound of the alloying element includes the step of providing the chemically reducible nonmetallic alloying-element precursor compound of the alloying element, wherein the alloying element chemically reacts with titanium in a liquid phase to form chemical compounds including titanium and the alloying element.

26. The method of claim 16, wherein the step of providing the chemically reducible nonmetallic alloying-element precursor compound of the alloying element includes the step of providing the chemically reducible nonmetallic alloying-element precursor compound of the alloying element, wherein the alloying element exhibits a miscibility gap with titanium in the liquid phase.

27. The method of claim 16, including an additional step, after the step of mixing and before the step of chemically reducing, of compacting the compound mixture.

28. The method of claim 16, wherein the step of chemically reducing includes the step of chemically reducing the compound mixture to produce the metallic alloy in the form of a sponge.

* * * * *